US008739419B1

(12) United States Patent
Pulkrabek et al.

(10) Patent No.: US 8,739,419 B1
(45) Date of Patent: Jun. 3, 2014

(54) BOW SIGHT WITH IMPROVED LASER RANGEFINDER

(75) Inventors: Larry Robert Pulkrabek, Osceola, IA (US); Jay Carl Engstrom, Port Wing, WI (US); Bill Edward Pedersen, Duluth, MN (US)

(73) Assignee: Field Logic, Inc., Superior, WI (US)

( * ) Notice: Subject to any disclaimer, the term of this patent is extended or adjusted under 35 U.S.C. 154(b) by 534 days.

(21) Appl. No.: 13/028,061

(22) Filed: Feb. 15, 2011

Related U.S. Application Data

(60) Provisional application No. 61/304,748, filed on Feb. 15, 2010.

(51) Int. Cl.
*F41G 1/467* (2006.01)
*F41G 1/473* (2006.01)

(52) U.S. Cl.
USPC ..... 33/265; 124/87

(58) Field of Classification Search
CPC ..... F41G 1/467; F41G 1/473; F41G 1/54; F41G 1/545; F41G 3/06; F41G 3/326
USPC ..... 33/265; 124/87; 42/114, 115
See application file for complete search history.

(56) References Cited

U.S. PATENT DOCUMENTS

| | | | | |
|---|---|---|---|---|
| 4,400,887 | A | | 8/1983 | Mason |
| 4,764,011 | A | | 8/1988 | Goldstein |
| 4,928,394 | A | | 5/1990 | Sherman |
| 5,072,716 | A | * | 12/1991 | Sappington ..... 124/87 |
| 5,080,084 | A | | 1/1992 | Kendall et al. |
| 5,157,839 | A | | 10/1992 | Beutler |
| 5,168,631 | A | | 12/1992 | Sherman |
| 5,201,124 | A | | 4/1993 | Sherman |
| 5,231,765 | A | | 8/1993 | Sherman |
| 5,303,479 | A | | 4/1994 | Rudovsky |
| 5,308,986 | A | | 5/1994 | Walker |
| 5,338,037 | A | | 8/1994 | Toyohara |
| 5,384,966 | A | | 1/1995 | Gibbs |

(Continued)

OTHER PUBLICATIONS

U.S. Appl. No. 12/726,594 entitled Eye Alignment Assembly, filed Mar. 18, 2010.

(Continued)

*Primary Examiner* — R. A. Smith
(74) *Attorney, Agent, or Firm* — Woods Patent Law

(57) ABSTRACT

A targeting system for a bow is disclosed. A laser rangefinder is offset from a designated pin on the bow sight such that a theoretical line of sight for the designated pin intersects with a rangefinder laser beam emitted by the laser rangefinder at a preset distance. An adjustment mechanism is provided that permits the position of the laser rangefinder relative to the bow to be adjusted such that the rangefinder laser beam and a user's actual line of sight along the designated pin intersect at a target located at the preset distant. The designated pin permits the user to aim the laser rangefinder at a selected target and adjust an elevation of the bow to an angle corresponding at least approximately to a range to the selected target displayed by the laser rangefinder. In one embodiment, the rangefinder laser and the bow sight form a unitary bow sight assembly. In another embodiment, electronics and other components associated with operation of the laser rangefinder are incorporated into a bow sight housing to form a unitary bow sight assembly that does not need to be operably connected to a bow mounting bracket for the supply of power or electrical signals thereto.

27 Claims, 15 Drawing Sheets

(56) References Cited

U.S. PATENT DOCUMENTS

| | | | | |
|---|---|---|---|---|
| 5,420,959 | A | 5/1995 | Walker et al. | |
| 5,442,861 | A | 8/1995 | Lorocco | |
| 5,479,712 | A * | 1/1996 | Hargrove et al. | 33/265 |
| 5,495,675 | A * | 3/1996 | Huang | 42/115 |
| 5,574,552 | A | 11/1996 | Dunne | |
| 5,575,072 | A | 11/1996 | Eldridge | |
| 5,606,638 | A | 2/1997 | Tymianski et al. | |
| 5,638,604 | A | 6/1997 | Lorocco | |
| 5,649,526 | A | 7/1997 | Ellig | |
| 5,685,081 | A | 11/1997 | Winegar | |
| 5,703,678 | A | 12/1997 | Dunne | |
| 5,782,002 | A * | 7/1998 | Reed | 33/265 |
| 5,850,700 | A | 12/1998 | Capson et al. | |
| 5,862,603 | A | 1/1999 | Ellig | |
| 5,914,775 | A * | 6/1999 | Hargrove et al. | 356/3.13 |
| RE36,266 | E | 8/1999 | Gibbs | |
| 5,956,854 | A | 9/1999 | Lorocco | |
| 6,000,141 | A | 12/1999 | Afshari | |
| 6,016,608 | A | 1/2000 | Lorocco | |
| 6,073,352 | A | 6/2000 | Zykan et al. | |
| 6,094,829 | A * | 8/2000 | Koestler, III | 33/265 |
| 6,122,833 | A | 9/2000 | Lorocco | |
| 6,199,286 | B1 * | 3/2001 | Reed et al. | 33/265 |
| 6,216,352 | B1 | 4/2001 | Lorocco | |
| 6,311,405 | B1 | 11/2001 | Slates | |
| 6,360,472 | B1 | 3/2002 | Lorocco | |
| 6,366,344 | B1 * | 4/2002 | Lach | 356/3.1 |
| 6,385,855 | B1 | 5/2002 | Tymianski | |
| 6,397,483 | B1 | 6/2002 | Perkins | |
| 6,401,347 | B1 | 6/2002 | Slates | |
| 6,421,946 | B1 | 7/2002 | LoRocco | |
| 6,477,778 | B1 | 11/2002 | Lorocco | |
| 6,477,780 | B2 | 11/2002 | Aldred | |
| 6,557,291 | B2 | 5/2003 | Hoadley | |
| 6,560,884 | B1 | 5/2003 | Afshari | |
| 6,564,462 | B1 | 5/2003 | Henry | |
| 6,571,482 | B1 | 6/2003 | Tymianski | |
| 6,581,317 | B1 | 6/2003 | Slates | |
| 6,634,110 | B2 | 10/2003 | Johnson | |
| 6,634,111 | B2 | 10/2003 | LoRocco | |
| 6,725,854 | B1 | 4/2004 | Afshari | |
| 6,796,037 | B1 | 9/2004 | Geffers et al. | |
| 6,802,129 | B1 | 10/2004 | Wirth | |
| 6,817,105 | B2 | 11/2004 | LoRocco | |
| 6,862,813 | B1 * | 3/2005 | Chen et al. | 33/265 |
| 6,938,349 | B2 | 9/2005 | Afshari | |
| 6,981,329 | B1 | 1/2006 | Strathman | |
| 7,036,234 | B2 | 5/2006 | Rager | |
| 7,086,161 | B2 | 8/2006 | Ellig et al. | |
| 7,200,943 | B2 | 4/2007 | Afshari | |
| 7,255,035 | B2 | 8/2007 | Mowers | |
| 7,290,345 | B2 | 11/2007 | Ellig | |
| 7,296,358 | B1 * | 11/2007 | Murphy et al. | 33/265 |
| 7,331,112 | B2 | 2/2008 | Gibbs | |
| 7,461,460 | B2 | 12/2008 | Priebe | |
| 7,464,477 | B2 | 12/2008 | Afshari | |
| 7,503,321 | B2 | 3/2009 | Afshari | |
| 7,535,553 | B2 | 5/2009 | Vermillion et al. | |
| 7,562,486 | B2 | 7/2009 | LoRocco | |
| 7,574,810 | B1 | 8/2009 | LoRocco | |
| 7,574,811 | B2 | 8/2009 | Kurtzhals et al. | |
| 7,814,668 | B1 | 10/2010 | Pulkrabek et al. | |
| 7,921,570 | B1 * | 4/2011 | Pulkrabek et al. | 33/265 |
| 8,046,951 | B2 * | 11/2011 | Peters et al. | 42/111 |
| 8,186,068 | B2 * | 5/2012 | Pulkrabek et al. | 33/265 |
| 8,276,282 | B2 * | 10/2012 | Mainsonneuve et al. | 33/265 |
| 8,282,493 | B2 * | 10/2012 | Roman et al. | 463/51 |
| 8,336,216 | B2 * | 12/2012 | Samuels et al. | 33/265 |
| 2003/0101604 | A1 * | 6/2003 | McGivern | 33/265 |
| 2005/0241207 | A1 * | 11/2005 | Staley, III | 42/105 |
| 2007/0137088 | A1 | 6/2007 | Peters et al. | |
| 2008/0231829 | A1 * | 9/2008 | Hinchliff et al. | 356/4.01 |
| 2009/0165314 | A1 * | 7/2009 | Khoshnood | 33/265 |
| 2009/0199418 | A1 | 8/2009 | LoRocco | |
| 2010/0115778 | A1 * | 5/2010 | Gorsuch et al. | 33/265 |
| 2011/0222046 | A1 * | 9/2011 | Overstreet | 356/4.01 |

OTHER PUBLICATIONS

U.S. Appl. No. 12/791,503 entitled Bow Sight and Eye Alignment Assembly With Phosphorescent Fiber, filed Jun. 1, 2010.

U.S. Appl. No. 12/684,775 entitled Eye Alignment Assembly for Targeting Systems, filed Jan. 8, 2010.

* cited by examiner

BOW SIGHT WITH IMPROVED LASER RANGEFINDER

RELATED APPLICATION

This patent application claims priority and other benefits from U.S. Provisional Patent Application Ser. No. 61/304,748 to Pulkrabek et al. filed Feb. 15, 2010 and entitled "Bow Sight with Improved Laser Rangefinder," the entirety of which is hereby incorporated by reference herein.

FIELD OF THE INVENTION

The present application relates to a bow targeting system comprising a bow sight and a laser rangefinder.

BACKGROUND

Known bow sights include bow sights with simple pin markers and bow sights with vertically aligned series of pins mounted in a generally annular frame or pin guard that protects the pins, where each such pin corresponds to a particular distance to a target. The archer visually estimates an approximate range to the target and then sights to the target using the aiming pin corresponding to the estimated range. Some sights have light gathering fiber optic filaments which provide a self powered illuminated dot (or "bright site pin") that the archer sees at the end of each aiming pin. These fiber optic multi-pin sights have greatly improved the utility of such sights in low light or low contrast lighting situations.

Since the range to the target may vary substantially, it is important that the distance for a particular shot be known with some degree of accuracy. The archer typically has to pre-measure or step off the distance to an anticipated target location from the archer's tree stand, blind, or other shooting location. Alternatively he must simply guess as to the approximate distance to the target to compensate for the effects of gravity on an arrow in flight to the target.

To address the problem of inaccuracy in estimating range, a laser rangefinder sight has been marketed by Bushnell of Overland Park, Kans. This rangefinder system has a laser range finding instrument mounted above a multiple pin bow sight. The rangefinder is actuated by a switch that is pressed by the archer's finger when the bow sight is aimed at a target. While the switch is depressed, the rangefinder laser calculates and displays the distance to the target to the archer. The archer then chooses which of several sighting pins to align with the target based on the distance displayed. For example, if the archer has preset the pins to distances of 10, 20, 30, 40, and 50 yards, the archer would choose the pin closest to the displayed target distance. In one model, the Bushnell laser rangefinder is integral with the multiple pin sight. The entire sight may also be removed from the bow and used as a hand held distance measurement device. In another Bushnell model, the rangefinder is modular and may be removed from the bow sight for use as a hand held distance measuring device.

U.S. Pat. No. 6,073,352 to Zykan et al., the entirety of which is hereby incorporated by reference herein, discloses a laser rangefinder bow sight adapted for use with a conventional multi-pin bow sight. When the rangefinder is triggered, the CPU determines the target distance and activates an LED that illuminates the pin or pins that most closely correspond to the measured distance.

Laser rangefinders for bow sights have not met with wide commercial success due to difficulties with mounting, calibrating and accurately aiming the laser rangefinder with respect to the bow sight.

SUMMARY

In one embodiment, there is disclosed a method of aiming a laser rangefinder using a pin on a bow sight mounted to a bow, the bow sight and laser rangefinder forming a unitary bow sight assembly, the method comprising mounting the laser rangefinder offset from a designated pin on the bow sight such that a theoretical line of sight for the designated pin intersects with a rangefinder laser beam emitted by the laser rangefinder at a preset distance, establishing an actual line of sight through the designated pin to a target located generally at the preset distance, activating the, rangefinder laser beam, and adjusting the laser rangefinder relative to the bow such that the rangefinder laser beam and the actual line of sight through the designated pin intersect at the target located at the preset distance.

In another embodiment, there is disclosed a targeting system for a bow comprising a laser rangefinder offset from a designated pin on a bow sight such that a theoretical line of sight through the designated pin, intersects with a rangefinder laser beam emitted by the laser rangefinder at a preset distance, an adjustment mechanism configured to permit a position and an orientation of the laser rangefinder with respect to the bow to be adjusted such that the rangefinder laser beam and an actual line of sight through the designated pin for a first user intersect at the preset-distance; and a display located on or within a pin guard or pin bezel adjacent to the designated pin, the display being configured to display a distance measured by the laser rangefinder, wherein the bow sight and laser rangefinder form a unitary bow sight assembly.

Further embodiments are disclosed herein or will become apparent to those skilled in the art after having read and understood the specification and drawings hereof.

BRIEF DESCRIPTION OF THE DRAWINGS

The drawings are not necessarily to scale. Like numbers refer to like parts or steps throughout the drawings, unless otherwise noted.

DETAILED DESCRIPTIONS OF SOME EMBODIMENTS

Figure 1A:
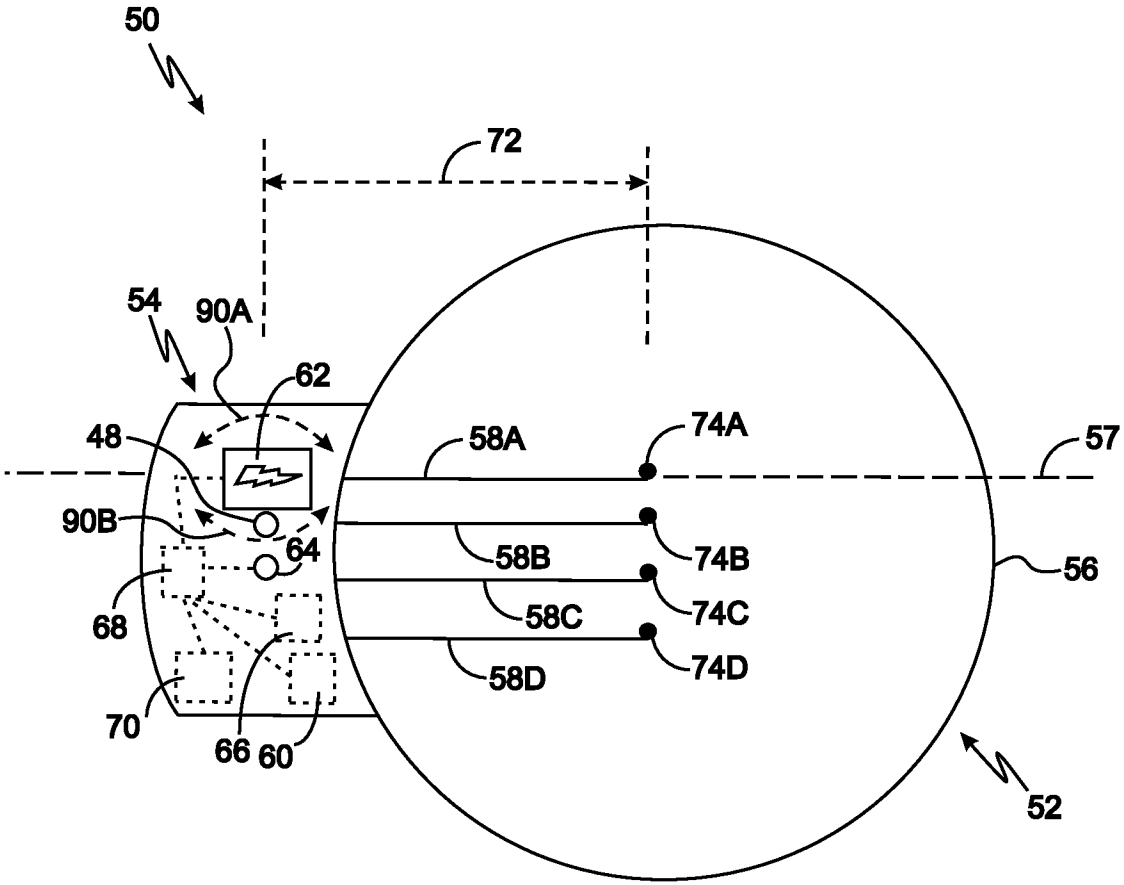
FIG. 1A is a schematic illustration of one embodiment of a multi-pin bow sight with a laser rangefinder viewed from a down-range side.

FIG. 1A is a schematic illustration of a targeting system 50 including a bow sight 52 with a laser rangefinder 54 viewed from the downrange side in accordance with one embodiment. Bow sight 52 includes a pin guard or pin bezel 56, and in one embodiment comprises a plurality of aiming pins 58A, 58B, 58C, 58D (collectively "58") having targeting portions 74A, 74B, 74C and 74D (collectively "74") disposed at or near ends thereof. The number of aiming pins 58 and the general configuration of the bow sight 52 can vary. For example, bow sight 50 can include one or a plurality of aiming pins 58. The systems and methods disclosed herein can be used with any suitable bow sight, such as for example, the bow sight disclosed in commonly assigned U.S. application Ser. No. 12/684,775, entitled EYE ALIGNMENT ASSEMBLY FOR TARGETING SYSTEMS, filed on Jan. 8, 2010, the entire disclosure of which is hereby incorporated by reference herein.

In some embodiments, laser rangefinder 54 comprises a power supply 60, a rangefinder laser beam transmitting section 62, a rangefinder laser beam receiving section 64, a timing circuit 66, and a central processing unit ("CPU") or other suitable processor or controller 68. Internal operation of laser rangefinder 54 according to some embodiments is more fully described in U.S. Pat. No. 5,574,552; U.S. Pat. No. 5,575,072; U.S. Pat. No. 5,703,678; U.S. Pat. No. 6,073,352; U.S. Pat. No. 6,397,483; U.S. Pat. No. 7,255,035; U.S. Pat. No. 7,535,553; and U.S. Pat. Publication No. 2007/0137088, all of which are hereby incorporated by reference, each in its respective entirety. Laser transmitting section 62 may be activated by trigger switch 65 (see FIG. 12, for example), and may also be mounted on a grip portion 67 of bow 69.

In one embodiment, CPU 68 is programmed with a sleep function that conserves power from the power supply 60 during periods of inactivity. A motion sensor or vibration sensor 70 may be provided in targeting system 50 to reactivate laser rangefinder 54 in response to the user moving the targeting system 50, such as for example to sight a target or drawing the bow string.

As shown in FIG. 1A, the laser transmitting section 62 from which the rangefinder laser beam is emitted by laser rangefinder 54 may be offset a distance 72 from targeting portions 74 of aiming pins 58. One embodiment includes configuring one of the aiming pins 58 as the designated pin used to aim the laser rangefinder 54. Any of the aiming pins 58 on bow sight 50 can be used as the designated pin, although in the embodiment shown in FIG. 1A, aiming pin 58A is the designated pin. The rangefinder laser beam emitted by laser transmitting section 62 of rangefinder 54 and designated pin 58A may be located in the same plane 57, although other configurations are contemplated. Plane 57 need not be horizontal as shown in FIG. 1A, and instead may include a vertical component. That is, offset 72 between designated pin 58A and the rangefinder laser beam emitted by laser transmitting section 62 of rangefinder 54 need not be arranged along a horizontal plane only, and indeed may assume any suitable tilt or orientation with respect to a horizontal plane. In one embodiment, offset 72 between designated pin 58A and the rangefinder laser beam emitted by laser transmitting section 62 of rangefinder 54 may be made as small as practicable to minimize sighting errors. In another embodiment, offset 72 between the rangefinder laser beam emitted by laser transmitting section 62 of rangefinder 54 and the designated pin 58A (or any other designated pin 58) is less than about six inches, less than about four inches, less than about three inches, less than about 2 inches, or may be any other suitable distance. In one embodiment, offset 72 corresponds approximately to the presentation and motion of most game animals as they move across or within bow sight 52. Laser rangefinder 54 may be calibrated relative to bow sight 52 in a factory setting to assure accurate alignment with respect to designated pin 58A (or any other designated pin 58).

Figure 12:
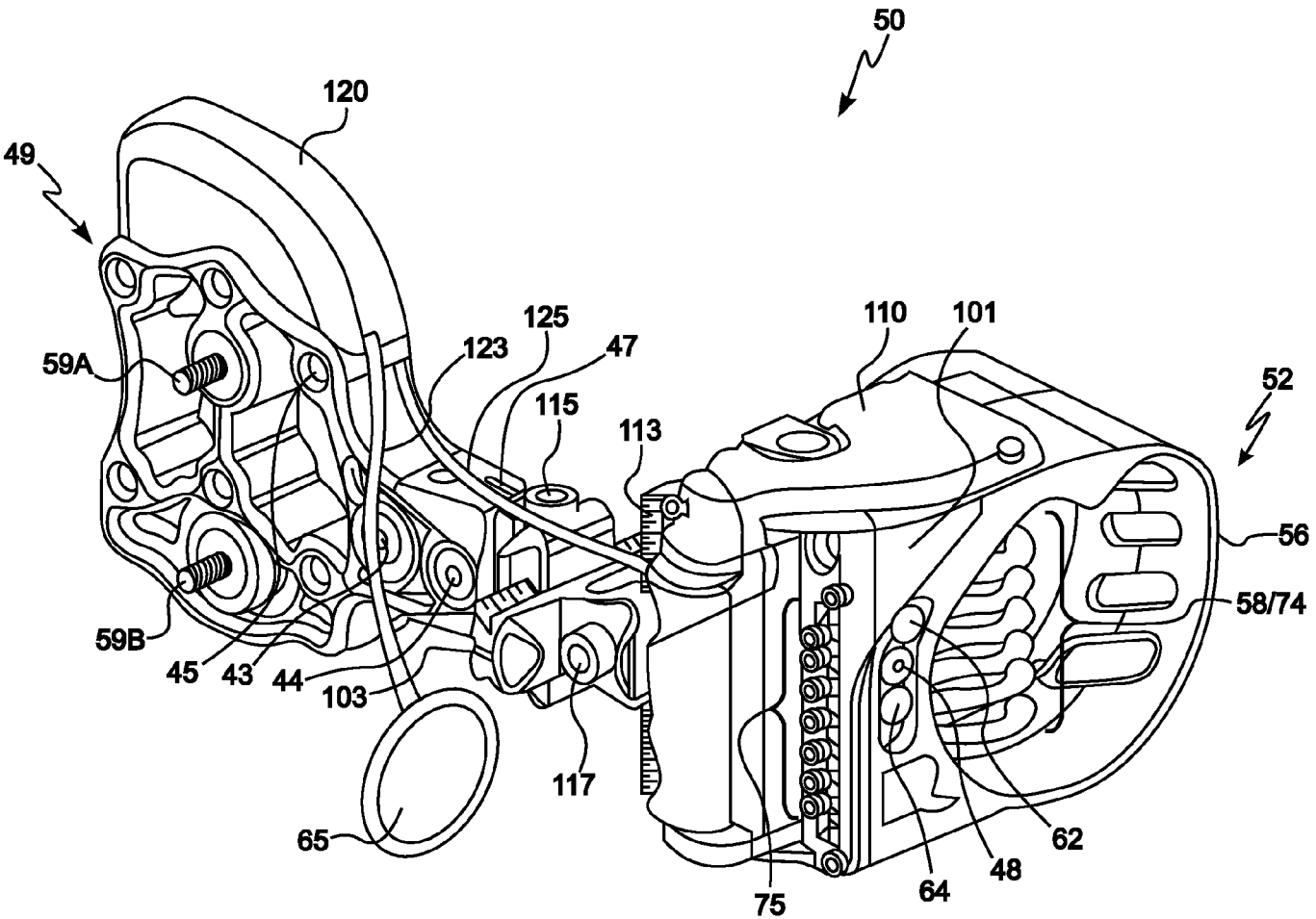
FIG. 12 is a top perspective view of one embodiment of a bow sight with an associated battery/CPU housing and trigger.

Note that FIG. 1A does not show a visible laser beam transmitting section 48 (see FIG. 12), which is configured to emit a visible laser beam 89 that is coincident or substantially coincident with rangefinder laser beam 84. Visible laser beam 89 indicates visually to a user where rangefinder laser beam 84 (which is generally not visible to the human eye) is directed. According to one embodiment, and as shown in FIG. 12, laser beam transmitting section 48 may be offset with respect to rangefinder laser beam transmitting section 62 without inducing appreciable or even noticeable aiming error.

Figure 1B:
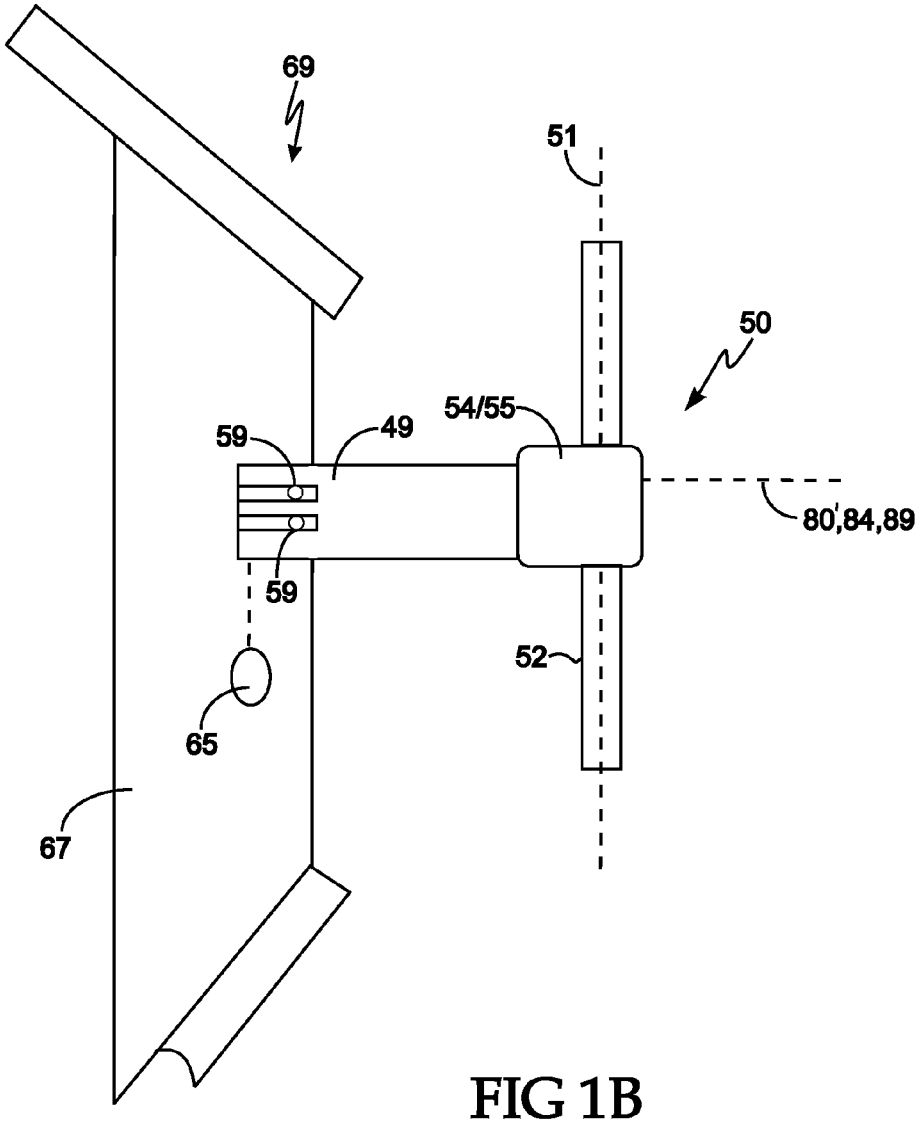
FIG. 1B is a schematic illustration of one embodiment of a multi-pin bow sight with a laser rangefinder mounted to a bow.

FIG. 1B illustrates one embodiment of targeting system 50 mounted to bow 69 by bow mounting bracket 49. According to one embodiment, bracket 49 may be configured to allow adjustment of the bow sight 52 relative to bow 69 in six degrees of freedom (x-axis, y-axis, z-axis, and three rotational axes—pitch, roll, and yaw), such as is disclosed in U.S. Pat. No. 6,634,110 to Johnson and U.S. Pat. No. 7,086,161 to Ellig et al., both of which patents are hereby incorporated by reference herein, each in its respective entirety. Note that other degrees of freedom of bow sight 52 relative to bow 69 are also contemplated. Some alternative embodiments of mounting brackets 49 are disclosed in U.S. Pat. No. 5,303,479, U.S. Pat. No. 5,442,861, and U.S. Pat. No. 6,477,778, each of which hereby incorporated by reference herein in its entirety.

According to one embodiment, aiming plane 51, as generally defined by targeting portions 74 of aiming pins 58 and by pin guard or pin bezel 56, is substantially perpendicular to a longitudinal axis of bow 69 or of an arrow immediately before release. In such an embodiment, theoretical line of sight 80' is oriented generally perpendicular to aiming plane 51 and extends through targeting portion 74A of the designated pin 58A. Note that according to some embodiments, however, aiming plane 51 and the longitudinal axis of bow 69 need not be perpendicular to one another, and may assume any suitable orientation and position respecting one another. "Theoretical line of sight" 80' refers to a line extends between a targeting portion of a designated pin and target 76, and as described above in some embodiments may be substantially perpendicular to aiming plane 51.

Figure 1C:
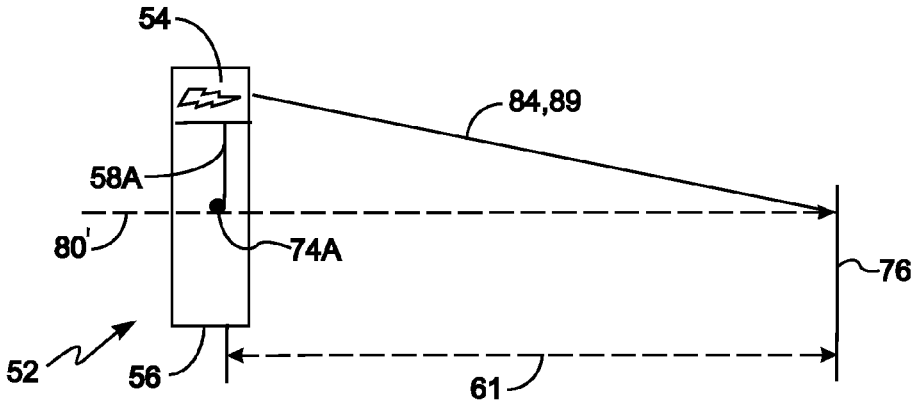
FIG. 1C is a top schematic view of a theoretical line of sight for a pin on a bow sight relative to a rangefinder laser beam emitted by a laser rangefinder according to one embodiment.

As illustrated in FIG. 1C, theoretical line of sight 80' of designated pin 58A intersects with visible laser beam 89 emitted by visible laser beam transmitting section 48 of laser rangefinder 54 at preset distance 61. Since visible laser beam 89 is co-linear or substantially co-linear with rangefinder laser beam 84, visible laser beam 89 provides a visible indication of where laser rangefinder beam 84 is aimed. Consequently, rangefinder laser beam 84 is aligned and oriented such that rangefinder laser beam 84 intersects the theoretical line of sight 80' at a given preset distance 61.

Preset distance 61 may be established in a factory setting, and is used when aligning the user's actual line of sight ("LOS") 80 along designated pin 58A with the rangefinder laser beam 84 and visible laser beam 89, as discussed above. Preset distance 61 can be, for example, 20 yards, 30 yards, 40 yards, 50 yards, 100 yards, etc. In one embodiment, pre-set distance 61 to target 76 is selected to be the maximum distance at which the user is capable of making consistently accurate shots, such as for example 100 yards. In another embodiment, distance 61 may be half the distance the user is capable of making consistently accurate shots. According to one embodiment, when purchasing bezel or targeting system 50, the customer may select a model with a preset distance 61 appropriate for his or her particular shooting style and skill.

Figure 2A:
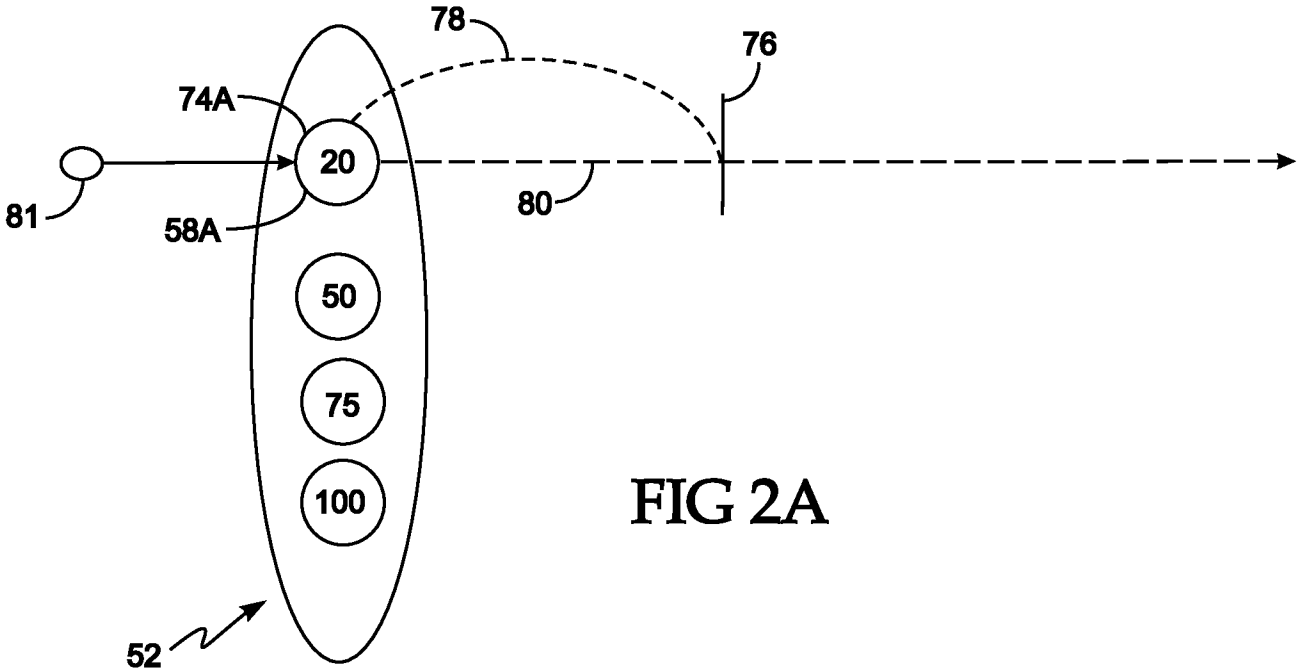
FIG. 2A is a schematic illustration of one embodiment of a method for calibrating the multi-pin bow sight of FIG. 1A.

FIG. 2A is a schematic side view of a method of sighting-in designated pin 58A for its assigned distance 61 in accordance with one embodiment. The user mounts bezel or targeting system 50 to bow 69 with bracket 49, and adjusts bezel or targeting system 50 up or down, and/or in or out, in accordance with the user's shooting form and preference. The user sights through aiming portion 74A of designated pin 58A with user's eye 81 to acquire target 76 located at a distance corresponding to and assigned for designated pin 58A. In the illustrated embodiment, designated pin 58A has an assigned distance of 20 yards. According to one embodiment, laser rangefinder 54 is not activated at this time.

The position of designated pin 58A may be fixed or set with respect to laser rangefinder 54 by adjusting the positions of one or both of pin 58*a* and rangefinder 54 relative to bow 69 until the user's actual line of sight 80 through designated pin 58A and the parabolic trajectory 78 of the arrow converge at target 76. A multi-axis mounting bracket 55 is particularly useful for such adjustments. Following this process, designated pin 58A is sighted-in for its assigned distance (e.g., 20 yards) in a manner similar to the sighting process employed to sight-in conventional multi-pin sights.

Figure 2B:
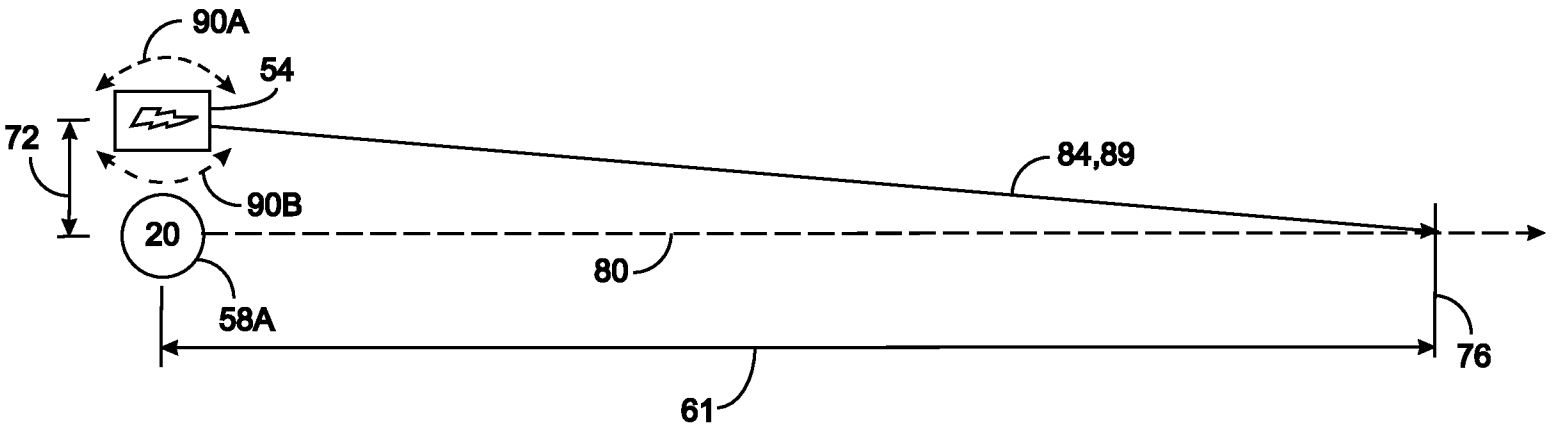
FIG. 2B is a top schematic illustration of one embodiment of a method for calibrating the laser rangefinder of FIG. 1A.

FIG. 2B is a top schematic illustration of one embodiment of a method for aligning laser rangefinder 54 with actual line of sight 80 through designated pin 58A for a particular user. Designated pin 58A is aimed at target 76, which may be located at preset distance 61 of FIG. 1C established at the factory. Rangefinder laser beam 84 and visible laser beam 89, which are coincident or substantially coincident, are then activated. As discussed above, and according to one embodiment, rangefinder laser beam 84 is characterized by a frequency of light that is not visible to the human eye, while visible laser beam 89 is characterized by a frequency of light that is visible to the human so that the user can determine if laser beam 84 intersects target 76 at the same location as the actual line of sight 80 corresponding to designated pin 58A.

In some embodiments, the theoretical line of sight 80' is co-linear with the user's actual line of sight 80. In most cases, however, the user adjusts the location of the targeting system 50 relative to the bow 69 so the user's actual line of sight 80 intersects the laser beam 84 at the target 88. This adjustment process customizes alignment of the sighting system 50 for the shooting style of a particular user. A variety of methods of making this adjustment are discussed below.

In one embodiment, the position of the targeting system 50 (including bow sight 52 and laser rangefinder 54) is adjusted relative to the bow 69 so that rangefinder laser beam 84 of laser rangefinder 54 intersects target 76 at the same location as the actual line of sight 80 of the designated pin 58A. For example, screws 59A and 59B retaining bracket 49 to bow 69 may be loosened to permit the required adjustment (see FIG. 12) so that targeting system 50 can be moved up or down and/or rotated as required. Other adjustments can also be made using third axis adjustment screws 43 and 44, fourth axis adjustment screw 45, mark 47, horizontal traveler 103, horizontal traveler adjustment screw 109, vertical traveler 113, and vertical traveler adjustment screw 117 as needed. See, for example, FIG. 12 and U.S. Pat. Nos. 5,303,479; 5,442,861, and 6,477,778 referenced above. Note that while such adjustments increase the accuracy of the designated pin 58A relative to aiming the laser rangefinder 54 at the target 88, they may also decrease the accuracy of the designated pin 58A at its assigned distance (e.g., 20 yards).

In another embodiment, targeting system 50 is rotated around an axis that is located in the horizontal plane 57 and extends through the designated pin 58A. The designated pin 58A may be configured to remain in plane 57 (see FIG. 1A) with only the targeting portion 74A potentially moving out of plane 57. Such an approach minimizes the displacement of the designated pin 58A relative to the bow 69, and hence, minimizes any resulting inaccuracy of the designated pin 58A at its assigned distance (e.g., 20 yards).

In yet another embodiment, the user pivots laser rangefinder 54 (e.g., the user adjusts the pitch and yaw 90A, 90B) portion of targeting system 50 relative to bow sight 52 so that rangefinder laser beam 84 intersects target 76 at exactly the same location as the actual line of sight 80 of the designated pin 58A. Designated pin 58A is not displaced relative to the bow 69, and thus the assigned distance for the designated pin 58A is unaffected. Designated pin 58A is now sighted-in to aim the rangefinder laser 54 at any target. Rangefinder laser beam 84 may then be turned off, since it is required only to align the actual line of sight 80 of the designated pin 58A with laser rangefinder 54.

Figure 3:
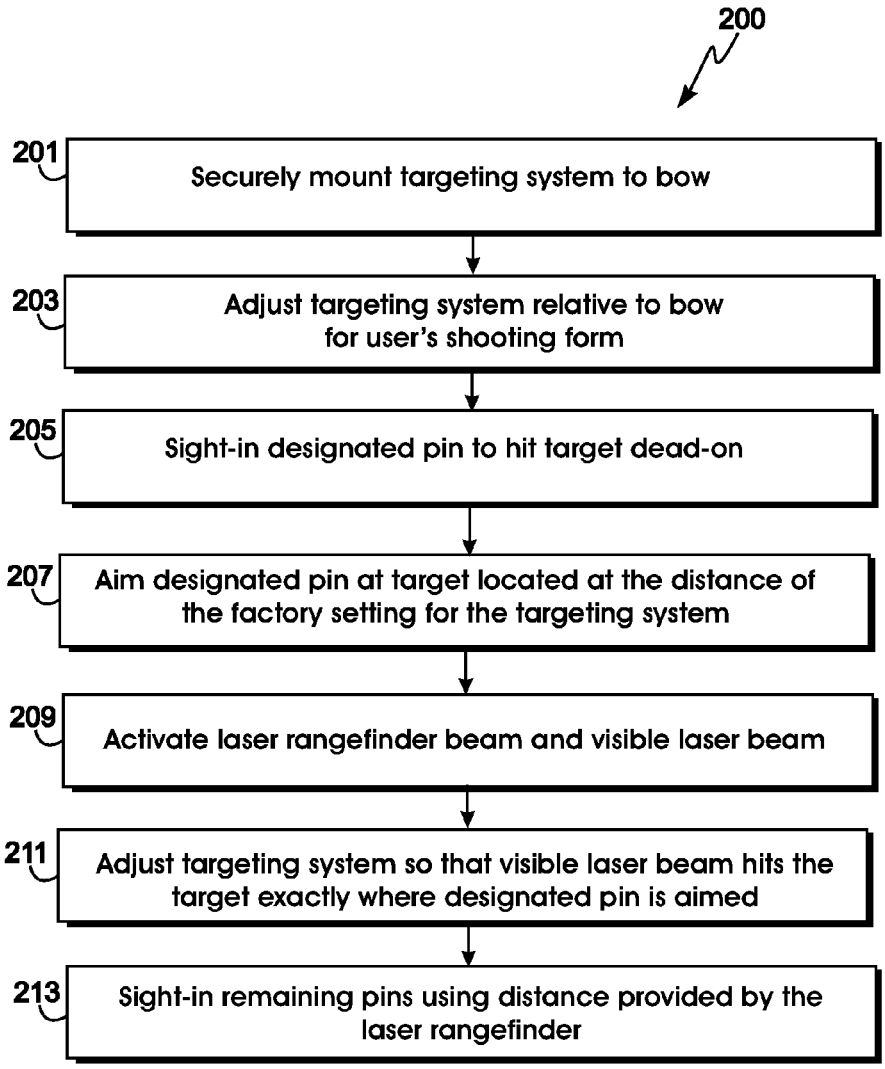
FIG. 3 is a flow chart illustrating one embodiment of a method of calibrating a targeting system.

FIG. 3 is a flow chart summarizing method 200 of calibrating targeting system 50 in accordance with one embodiment. At step 201, targeting system 50 is securely mounted to bow 69. The location of the targeting system 50 is then adjusted up or down, and/or in and out for the user's shooting style and form at step 203. The designed pin 58A is then sighted-in for the desired distance. Typically, target 76 is located at a distance assigned for designated pin 58A. Designated pin 58A is used to aim bow 69 at target 76 located at the assigned distance for that pin. The location of designated pin 58A is then adjusted until target 76 is hit dead-on at step 205.

At step 207, designated pin 58A is now aimed at target 76 located at the preset distance (i.e., pre-set distance 61, where rangefinder laser beam 84 intersects the theoretical line of sight 80' for the designated pin 58A, as illustrated in FIG. 1C). Rangefinder laser beam 84 is then activated at step 209. Targeting system 50 is adjusted at step 211 so that rangefinder laser beam 84 hits the target exactly where the designated pin 58A is aimed along the user's actual LOS 80. Designated pin 58A is now ready to aim laser rangefinder 54 at target 76. Rangefinder laser beam 84 can now be turned off and is not required except to repeat the set-up procedure.

The remaining pins 58B, 58C, 58D are then sighted-in to their assigned distances at step 213. The distance to target 76 may be measured using laser rangefinder 54. For example, the user may position herself at a distance from target 76 corresponding to a particular pin 58 on the sight 52. Switch 65 is then activated to confirm the distance to target 76. The user can move towards or away from target 76 until the exact distance is reached. The corresponding pin 58 is then sighted-in using the technique discussed above. This procedure is repeated for each pin 58.

Figure 4A:
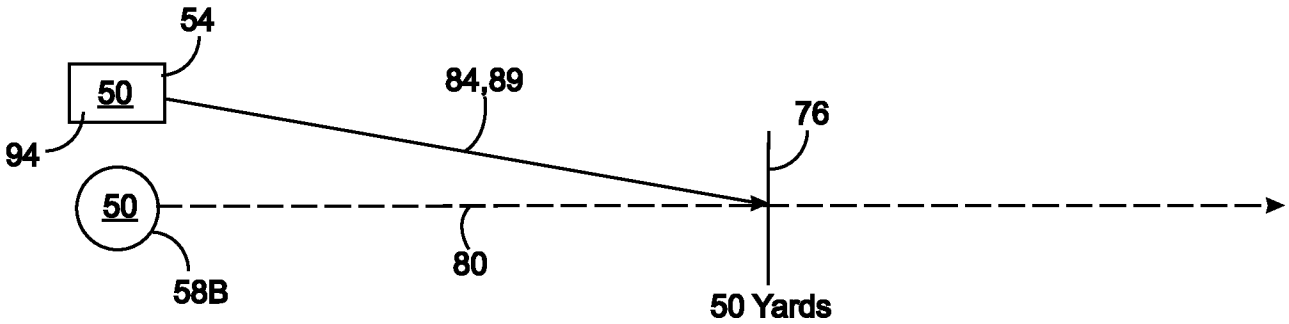
FIG. 4A is a top schematic illustration of one embodiment of a method for aiming the laser rangefinder of FIG. 1A.
Figure 4B:
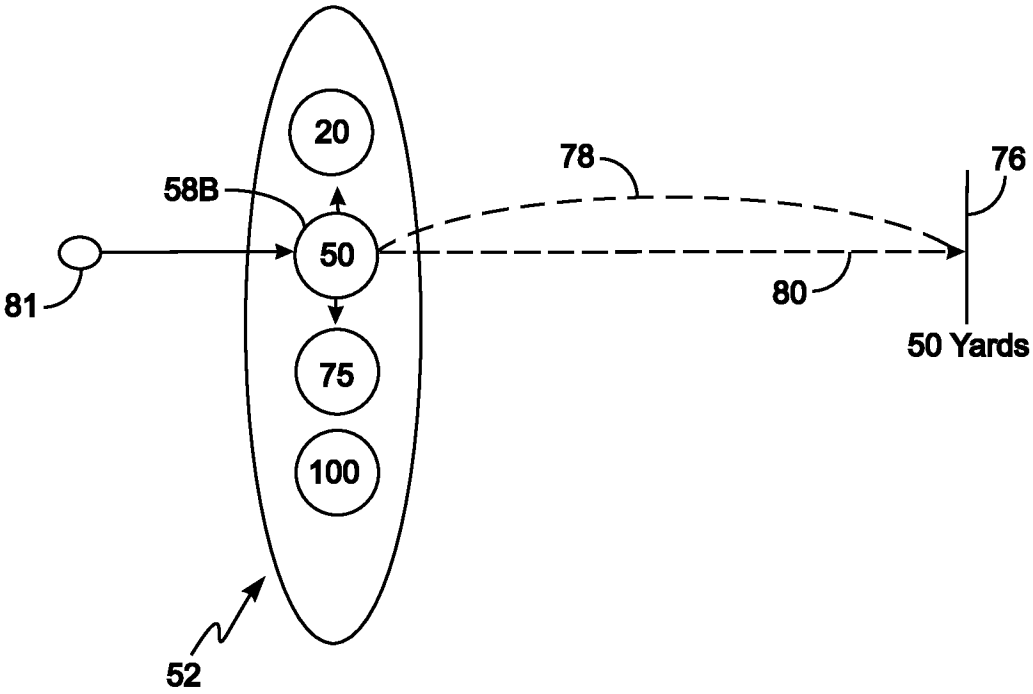
FIG. 4B is a schematic illustration of one embodiment of a method for calibrating a 50 yard pin on the multi-pin bow sight of FIG. 1A.

FIGS. 4A and 4B are schematic illustrations of a method of sighting-in the second pin 58B in accordance with an embodiment of the present invention. In this embodiment, the second pin 58B is sighted-in at 50 yards.

As illustrated in FIG. 4A, the user positioned herself at about 50 yards from target 76. Second pin 58B is used to aim laser rangefinder 54 at target 76 along the user's actual LOS 80. Laser rangefinder 54 is then activated, such as by pressing switch 65 on bow 69. Display 94 on laser rangefinder 54 displays the distance to target 76. In this example, the distance is 50 yards. The user optionally moves towards or away from target 76 until laser rangefinder 54 displays exactly 50 yards.

FIG. 4B is a side view of the method of sighting-in the second pin 58B on bow sight 52 shown in FIG. 4A. The flight path or trajectory 78 of the arrow is generally parabolic. The user's actual LOS 80 along second pin 58B to target 76 is a straight line. Second pin 58B is adjusted up or down until the user's actual LOS 80 through pin 58B and trajectory 78 converge at target 76. Second pin 58B is now sighted-in for 50 yards. This process is then repeated for the pins 58C and 58D at the different distances corresponding thereto.

Figure 5:
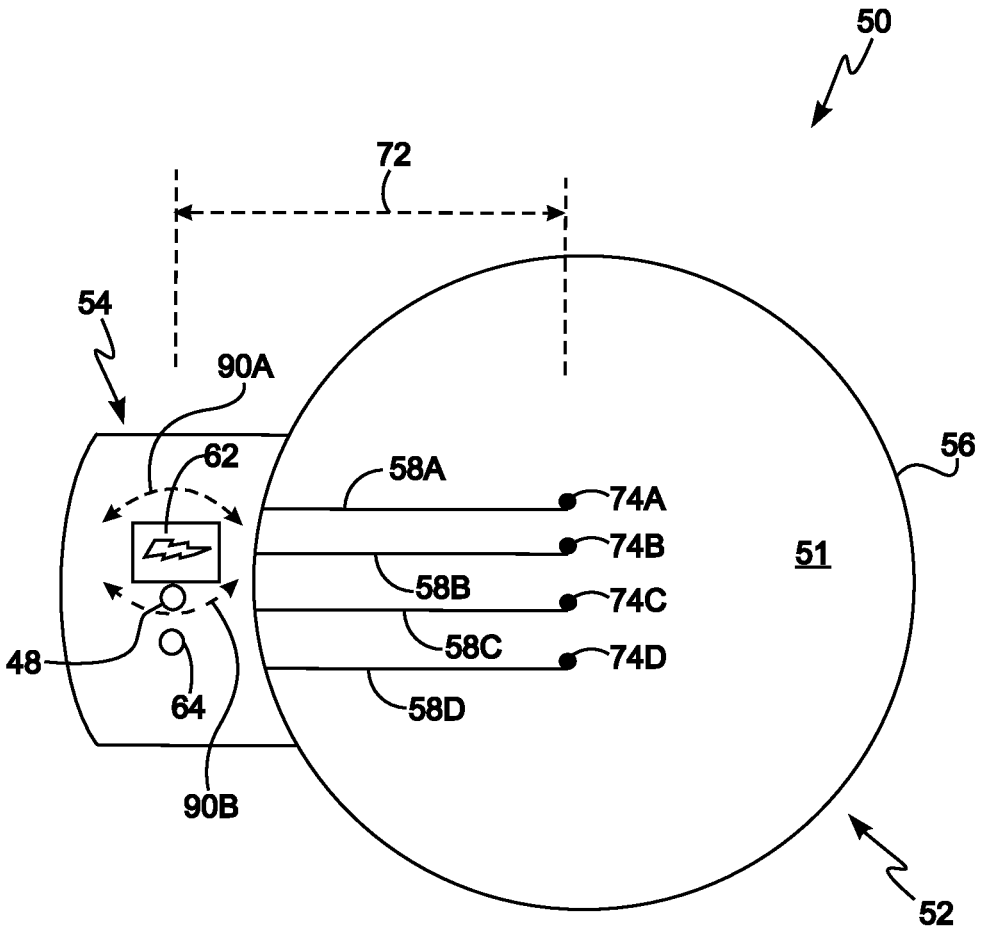
FIG. 5 is a schematic illustration of another embodiment of a multi-pin bow sight with a laser rangefinder.

FIG. 5 illustrates one embodiment of targeting system 50 viewed from the downrange side. As shown, laser rangefinder 54 is mounted in alignment with pin 58B. The method illustrated in FIGS. 2A, 2B and 3 is repeated, except that pin 58B is used as the designated pin for aiming the laser rangefinder 54. Other pins 58A, 58C, and 58D are then sighted-in as discussed above. Note that bow sight 52 and laser rangefinder 54 may be configured such that any of pins 58A, 58B, 58C and 58D may be employed as the designated pin.

Figure 6:
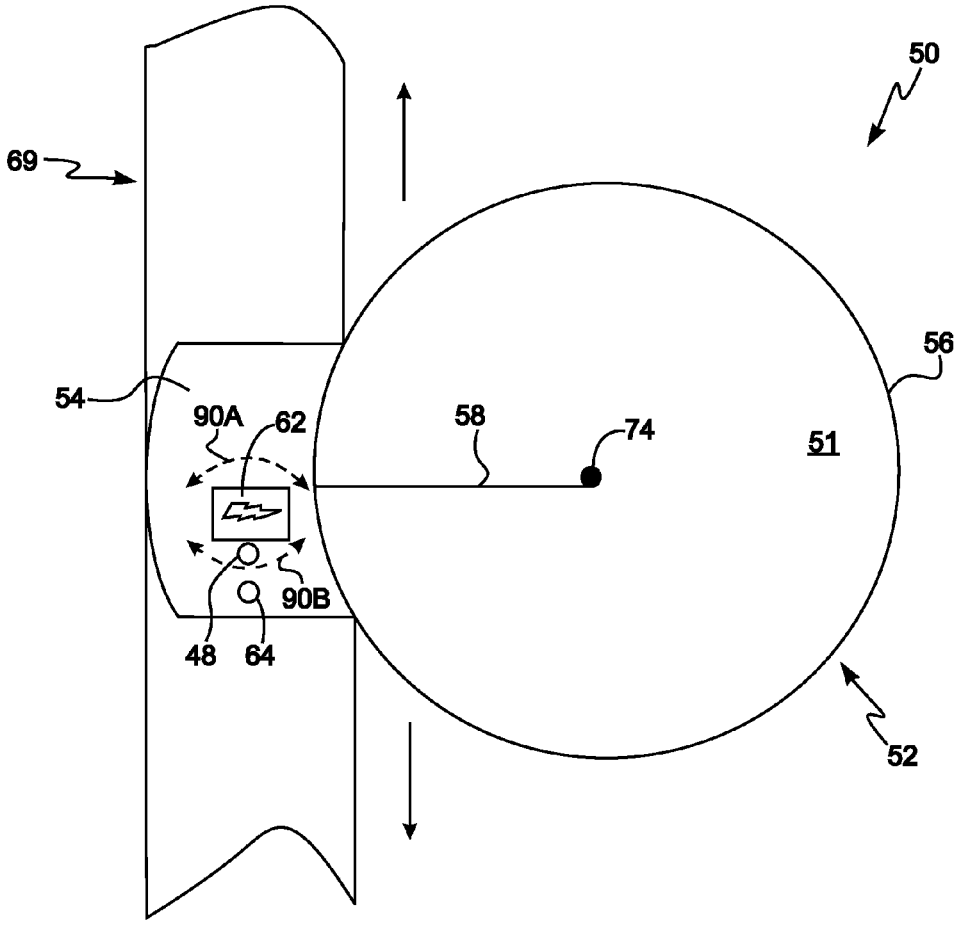
FIG. 6 is a schematic illustration of one embodiment of a single-pin bow sight with a laser rangefinder.

FIG. 6 illustrates another embodiment of targeting system 50 viewed from the downrange side, where a single pin bow sight 52 and laser rangefinder 54 are employed. By way of example, suitable single pin sights are available from HHA Sports™ located in Wisconsin Rapids, Wis., such as Optimizer-Lite™ and Pro 5000™ single pin sights. As illustrated, and in one embodiment, laser rangefinder 54 is mounted next to pin 58. Other positions of pin 58 and laser rangefinder 58 are also contemplated. Targeting system 50 is mounted to bow 69.

Continuing to refer to FIG. 6, pin 58 is sighted-in by moving the entire targeting system 50 relative to bow 69. Once the location of pin 58 is fixed relative to the bow 69, laser rangefinder 54 and rangefinder laser beam 84 are activated. Targeting system 50 is adjusted so that rangefinder laser beam 84 of laser rangefinder 154 intersects target 76 at the same location as the actual line of sight of designated pin 58 using any of the techniques discussed above.

Pin 58 is now ready to be used to aim laser rangefinder 154 at target 78. Rangefinder laser beam 84 can be turned off since it is only used during this initial set-up procedure. Bow sight 52 is then sighted-in for other distances using the distance measured by the laser rangefinder 54.

Figure 7:
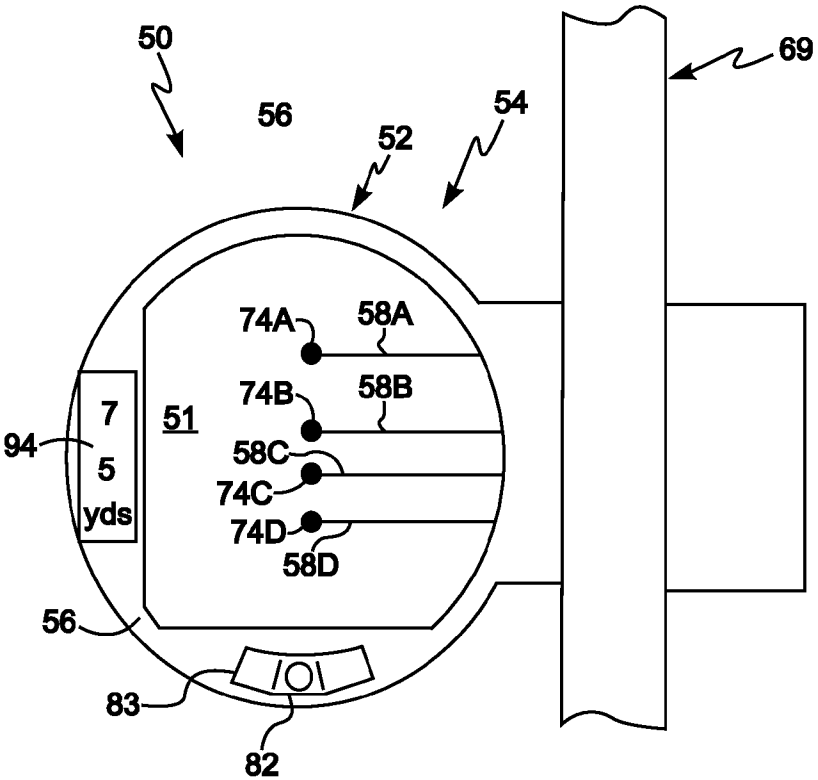
FIG. 7 is a schematic illustration of a one embodiment of a bow sight viewed from a user's perspective with a digital display on a pin guard or pin bezel.

FIG. 7 illustrates another embodiment of targeting system 50 viewed from the up-range side or the user's perspective. Laser range finder 54 can be located on the bow sight 52 or bow 69. Display 94 is configured to display the distance to target 76 measured by laser rangefinder 54, and in one embodiment is located on, near or within pin guard or pin bezel 56, or in other suitable locations. Display 94 may be an LED or LCD device, or any other suitable display device. In embodiments using an LCD device, backlighting may optionally be included to enhance readability under low light conditions. The embodiment of FIG. 7 permits the user to view a target through the aiming plane 51 framed by the pin guard or pin bezel 56, while simultaneously permitting display 94 and level assembly 83 and level 82 to be viewed by the user. Level 82 may also be located on or within pin guard or pin bezel 56. Level 82 may be a conventional bubble level, a digital level or any other suitable level device. In the embodiment of FIG. 7, level assembly 83 includes a digital bubble 82 made to look like a conventional bubble level. Note that according, to some embodiments digital level 82 comprises an LCD or LED display, and further that digital level 82 may be backlit.

Figure 8A:
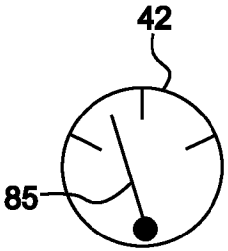
FIGS. 8A and 8B illustrate alternative embodiments of a digital level mounted on a pin guard or pin bezel.
Figure 8B:
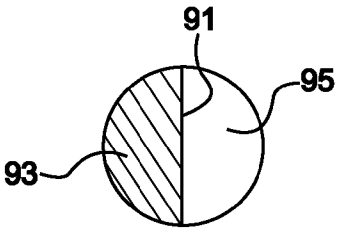

FIGS. 8A and 8B illustrate alternative embodiments of a digital level assembly 83. In FIG. 8A, needle 85 moves according to the position and orientation of bow 69. When needle 85 is aligned with mark 42, bow 69 is substantially level. In the embodiment of FIG. 8B, line 91 between light region 93 and dark region 95 rotates depending on the orientation or roll position of bow 69. When line 91 is vertical, bow 69 is properly oriented.

FIGS. 9 through 12 illustrate further embodiments of targeting system 50, and as will be seen share some common features.

Figure 9:
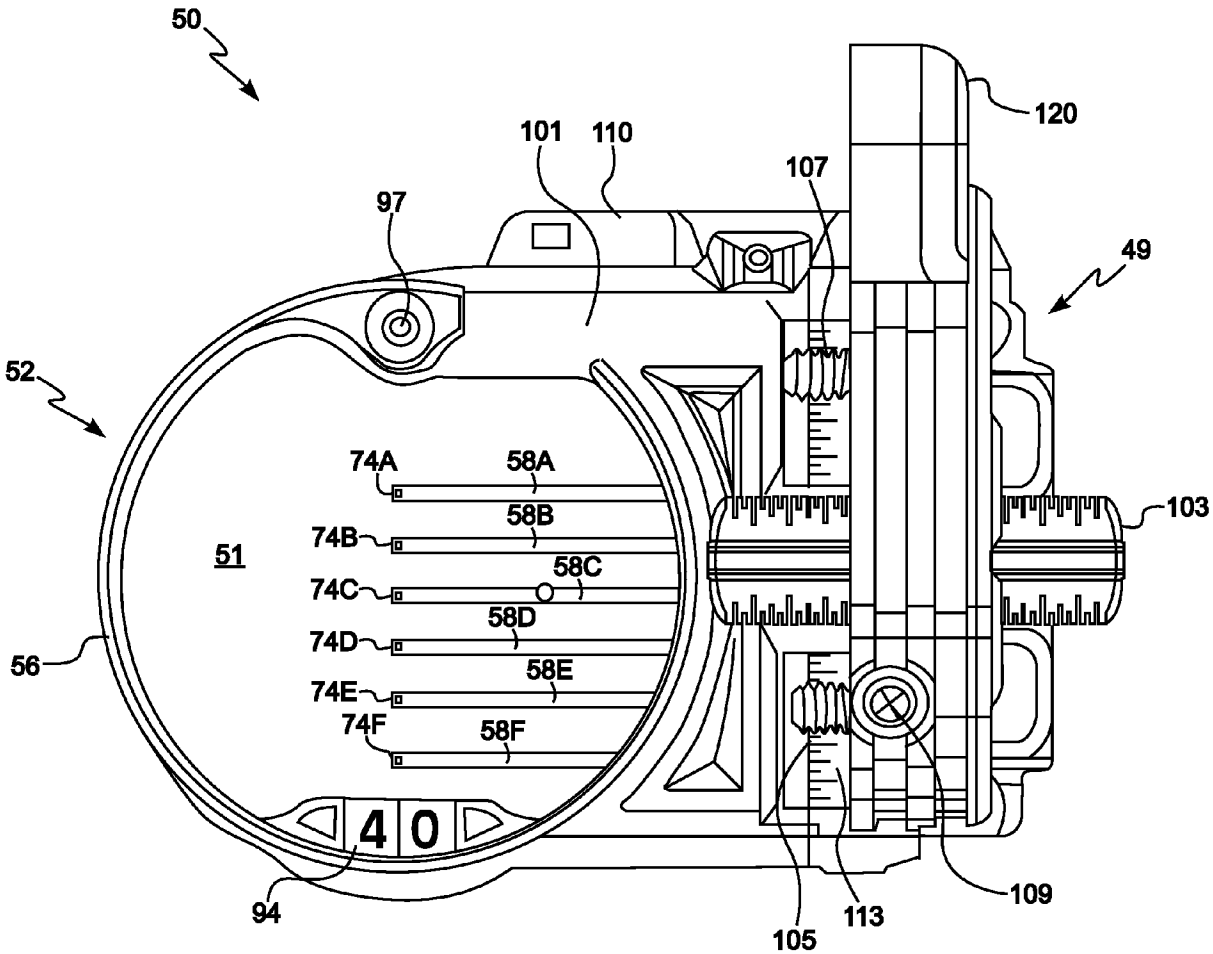
FIG. 9 is a schematic illustration of one embodiment of a bow sight viewed from a user's perspective with a digital display on a pin guard or pin bezel.

In FIG. 9, one embodiment of targeting system 50 is shown as viewed from the up-range side or the user's perspective, where laser rangefinder 54 is located atop, to the side of, within, and/or adjacent to pin guard or pin bezel 56 and/or bow sight 52. Note, however, that in this and other embodiments illustrated and disclosed herein, other locations for laser range finder 54 in targeting system 50 are also contemplated, such as within or adjacent to housing 101, and other locations. Display 94 is configured to display the distance to target 76 measured by laser rangefinder 54, and in the embodiment illustrated in FIG. 9 is located on or within a bottom portion of pin guard or pin bezel 56. As described above, display 94 may be an LED or LCD display device, and in one embodiment is backlit to enhance readability in low light conditions. The embodiment of FIG. 9 permits the user to view target 76 through aiming plane 51 framed by pin guard or pin bezel 56, while simultaneously being able to view the display 94. Note that the embodiment shown in FIG. 9 does not include level assembly 83.

As further shown in FIG. 9, sight alignment device 96, which in one embodiment is a "RETINA LOCK" device manufactured by FIELD LOGIC™ of Superior, Wisconsin, aids the user in properly orienting bow sight 52 relative to target 76 so that aiming plane 51 is substantially perpendicular thereto. In one embodiment, and as shown in FIGS. 9 through 12, translucent or light transmissive housing 110 is disposed atop housing 101 and permits ambient light to pass therethrough for collection by fiber optic strands (not shown in FIG. 9), which in turn collimate the collected light and direct it through such strands to the tips of portions 74A-74D of aiming pins 58A-58D, thereby producing visually brightened aiming pin tips to aid the user in sighting and aiming at target 76. Such tips are known as "bright sights," and are known in the art.

Figure 10:
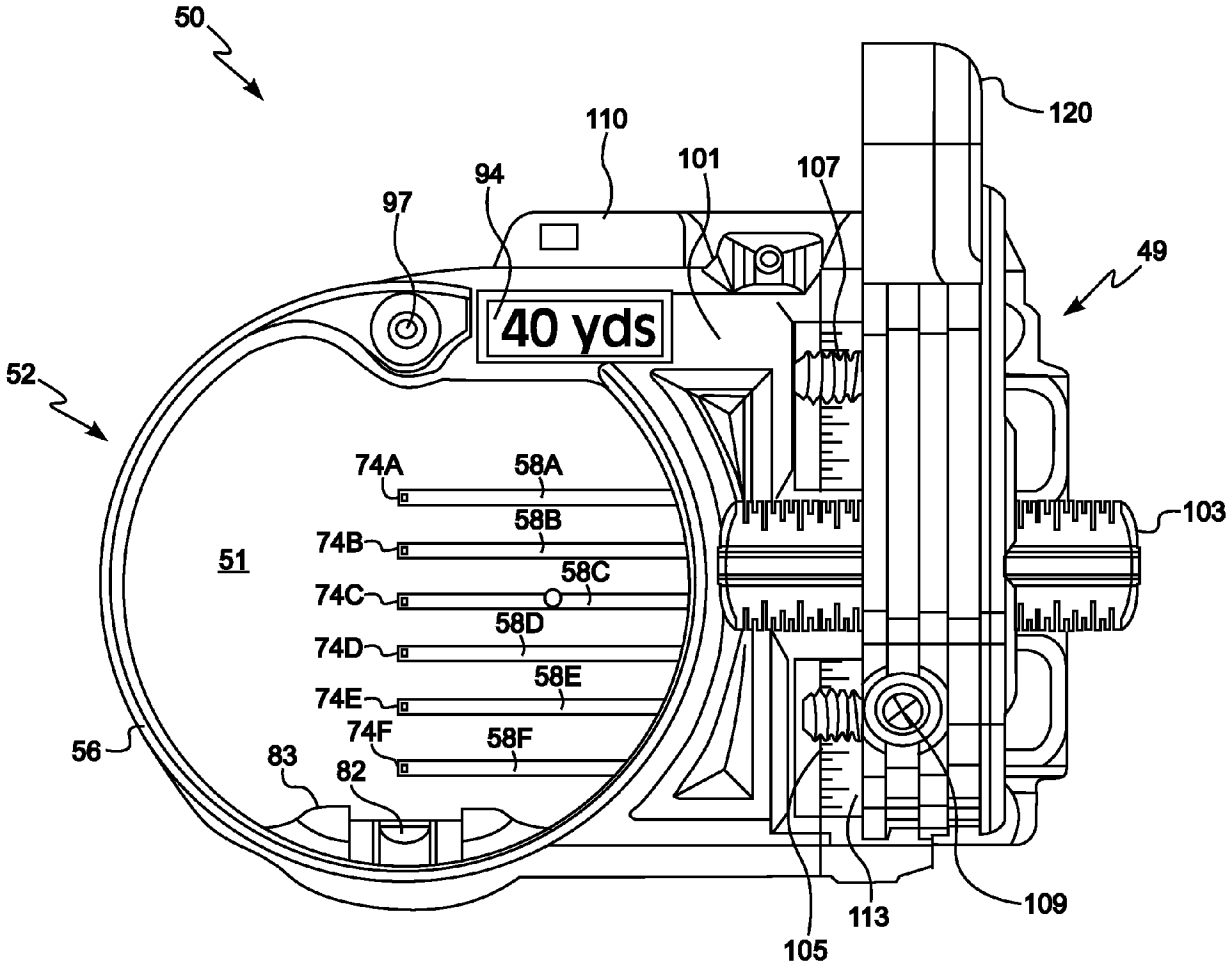
FIG. 10 is a schematic illustration of another embodiment of a bow sight viewed from a user's perspective with a digital display on a pin guard or pin bezel.

The embodiment of FIG. 9 also includes horizontal traveler 103 and vertical traveler 113, which in conjunction with adjustments that can be made to bracket 49, are used to adjust the position of bow sight 52 relative to bow 69 in the manner described above In FIG. 10, another embodiment of targeting system 50 is viewed from the up-range side or the user's perspective, where laser range finder 54 is located atop or to the side of bow sight 52. Display 94 is configured to display the distance to target 76 measured by laser rangefinder 54. The embodiment of FIG. 10 permits the user to view a target through aiming plane 51 framed by pin guard or pin bezel 56, while simultaneously being able to view the display 94. In FIG. 10, level assembly 83 is located on or within a bottom portion of pin guard or pin bezel 56, although other locations for level assembly 83 are also contemplated, such as on, within, or adjacent to a side portion of pin guard or pin bezel 56, on, within, or adjacent to a top portion of pin guard or bezel 56, or on, within or adjacent to housing 101.

Figure 11:
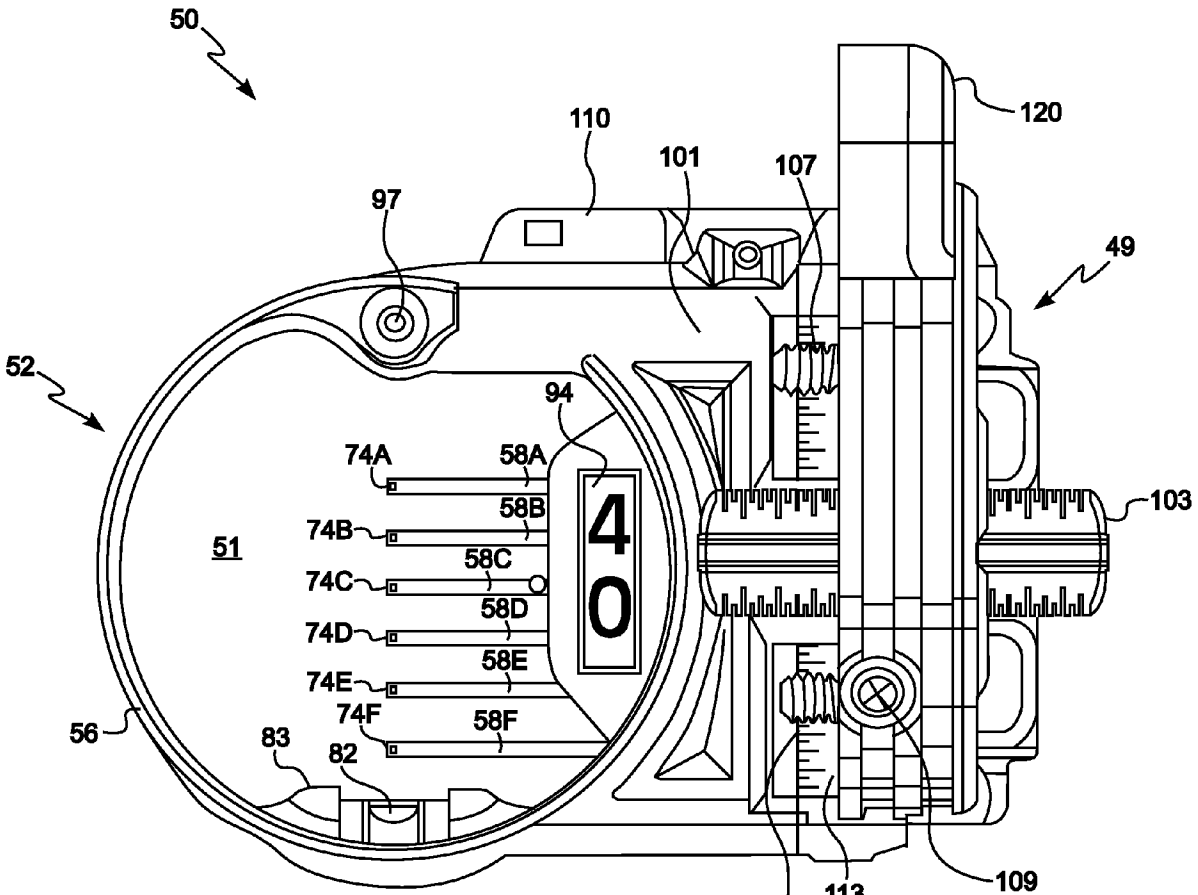
FIG. 11 is a schematic illustration of yet another embodiment of a bow sight viewed from a user's perspective with a digital display on a pin guard or pin bezel.

In FIG. 11, yet another embodiment of targeting system 50 is shown as viewed from the up-range side or the user's perspective, where the laser range finder 54 is located to the side of bow sight 52. Display 94 is configured to display the distance to target 76 measured by laser rangefinder 54. The embodiment of FIG. 11 permits the user to view target 76 through aiming plane 51 framed by pin guard or pin bezel 56, while simultaneously being able to view display 94. In FIG. 11, level assembly 83 is located on or within a bottom portion of pin guard or bezel 174, although other locations for level assembly 83 are also contemplated as described above.

FIG. 12 shows a top perspective view of one embodiment of targeting system 50 comprising bow sight 52, mounting bracket 49, battery/CPU housing 200, horizontal traveler 103, vertical traveler 113, trigger 65, trigger cable 123, and CPU/battery cable 125. Bow sight 52 comprises pin guard or pin bezel 56, which is attached to or forms a portion of housing 101. Translucent or light transmissive cover 110 is disposed atop housing 101, and includes individual fiber optic strands that are routed through housing 101 to the tips of aiming pins 58A-58D. Aiming pin extensions 75 project through housing 101 to a side opposite bow sight 52. In one embodiment, trigger 65 is wireless, thereby dispensing with the need for trigger cable 123. In another embodiment, CPU 68 and battery or power supply 60 are located in housing 101, thereby dispensing with the need for CPU/battery cable 125. As further shown in FIG. 12, rangefinder laser beam transmitting section 62 is disposed on the down-range side of targeting assembly 50 and offset from rangefinder laser beam receiving section 64, with visible laser transmitting section 48 disposed therebetween. Other configurations and positions of rangefinder laser beam transmitting section 62, rangefinder laser beam receiving section 64, and visible laser transmitting section 48 respecting one another are also contemplated, as discussed above.

In one embodiment, bow sight 52 and laser rangefinder 54 form a unitary bow sight assembly. Placing all the principal components of laser rangefinder 54 and bow sight 52 into a single housing or bow sight assembly has certain advantages, including eliminating the need to route electrical connections between portions of bracket 49 and bow sight 52.

It will now be seen that the various embodiments disclosed herein eliminate the need for a separate sighting mechanism for laser rangefinder 54. Laser rangefinder 54 can be aimed at target 76 more accurately than in prior systems, resulting in more accurate distance measurements. Combining laser rangefinder 54 with bow sight 52 also reduces the time between measuring the distance to target 76 and firing.

The steps of measuring the distance to target 76 using laser rangefinder 54 and adjusting the elevation of bow 69 based on the distance displayed are both performed with target 76 framed by the pin guard or pin bezel 56 of bow sight 52. The archer never needs to take her eye off target 76. Locating display 94 for laser rangefinder 54 on or within the pin guard or pin bezel 56 further simplifies the process. An analog or digital level 82 may also be located on or within the pin guard or pin bezel 56.

As discussed above, and according to some embodiments, laser rangefinder 54 may be located off-set from the designated pin 58 used to aim laser rangefinder 54 such that both are located in the same plane. The off-set, which may be horizontal, corresponds to the presentation and motion of most game animals. The distance between designated pin 58 used to aim laser rangefinder 54 and laser rangefinder 54 may be minimized to increase shooting accuracy. In one embodiment, the offset between the laser rangefinder and the designated pin is less than about six inches, less than about four inches, or less than about three inches.

It will be appreciated that a designated pin 58 has a theoretical line of sight 80' and an actual line of sight 80 associated with a particular user. While the theoretical line of sight 80' and actual line of sight 80 are ideally the same, in most circumstances the two lines of sight are slightly different due to the shooting style of a particular user.

The theoretical line of sight 80' corresponding to the designated pin 58 is a line extending through the targeting portion of the designated pin 58 and substantially perpendicular to the aiming plane 51 of the bow sight 52. The intersection of the theoretical line of sight 80' of the designated pin 58 and the laser rangefinder 54 in the plane 57 may be adjusted at the factory for a particular distance. For example, laser rangefinder 54 and theoretical line of sight 80' of designated pin 58 can be adjusted to intersect at 50 yards, 100 yards, etc.

During the manufacturing process, laser rangefinders 54 and bow sights 52 may be configured to correspond to different predetermined or pre-set distances. The preset distances can correspond to maximum distances at which given users are capable of consistently making accurate shots. A given user may thus select a bow sight with a preset distance corresponding to his or her level of shooting skill.

Alignment of laser rangefinder 54 with actual line of sight 80 of designated pin 58 is performed by the user after targeting system 50 has been mounted to bow 69. Since actual line of sight 80 will vary from user-to-user, this adjustment may be customized for each user.

In one embodiment, adjusting targeting system 50 for a particular user involves adjusting the relative positions of some of the components of targeting system 50. In one embodiment, bow sight 52 and laser rangefinder are adjusted such that rangefinder laser beam 84 intersects target 76 at the same location as actual line of sight 80 for a particular user sighting through the designated pin 58. This adjustment can be linear, rotary or a combination thereof. In another embodiment, targeting system 50 rotates about an axis located in a plane associated with laser rangefinder 54 and designated pin 58. In yet another embodiment, the pitch and yaw of laser rangefinder 58 can be adjusted relative to the designated pin 58.

Unless defined otherwise, all technical and scientific terms used herein have the same meaning as commonly understood by one of ordinary skill in the art to which these inventions belong. Any methods and materials similar or equivalent to those described herein can also be used in the practice or testing of the present inventions. All patents and publications mentioned herein, including those cited in the Background of the application, are hereby incorporated by reference herein, each in its respective entirety. Note that the publications referenced and discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates, which may need to be independently confirmed.

Embodiments other than those disclosed explicitly herein are also contemplated. Although the above description is quite specific, this should not be construed as limiting the scope of the systems, devices, components and methods that are contemplated, but are provided merely as illustrations of some of the embodiments. It is also contemplated that various combinations or sub-combinations of the specific features and aspects of the embodiments may be made and still fall within the scope of the systems, devices, components and methods that are contemplated. It should be understood that various features and aspects of the disclosed embodiments can be combined with or substituted for one another in order to form other embodiments. Thus, it is intended that the scope of at least some of the systems, devices, components and methods disclosed herein are not limited by the particular embodiments described herein.

The above-described embodiments should be considered as examples of the present invention, rather than as limiting the scope of the invention. In addition to the foregoing embodiments of the invention, review of the detailed description and accompanying drawings will show that other embodiments are contemplated. Accordingly, many combinations, permutations, variations and modifications of the foregoing embodiments not set forth explicitly herein will nevertheless fall within the scope of the various embodiments.

Note that included within the scope of the various embodiments disclosed herein are methods of making and having made the various components, devices and systems described herein.

We claim:

1. A method of aiming a laser rangefinder using a designated pin on a bow sight mounted to a bow, the bow sight and laser rangefinder forming a unitary bow sight assembly, the bow sight comprising a pin guard or pin bezel and a display, the laser rangefinder being offset from the designated pin on the bow sight such that a theoretical line of sight for the designated pin intersects with a rangefinder laser beam emitted by the laser rangefinder at a preset distance, the method comprising:

establishing an actual line of sight through the designated pin to a target located generally at the preset distance;

activating the rangefinder laser beam;

displaying a range to the target on the display, and;

while viewing the target through the designated pin, adjusting an orientation of the designated pin, and adjusting a pitch and a yaw of the laser rangefinder relative to the bow with pitch and yaw adjustment controls such that the rangefinder laser beam and the actual line of sight through the designated pin intersect at the target located at the preset distance;

wherein the display is located within the pin guard or pin bezel, and the pitch and yaw adjustment controls are located on or within the pin guard or pin bezel, such that a user viewing the target framed by the pin guard or pin bezel can simultaneously view the display while adjusting the orientation of the designated pin and the pitch and yaw of the laser rangefinder.

2. The method of claim 1, further comprising activating a visible laser beam when the rangefinder laser beam is activated, the visible laser beam being substantially coincident with the rangefinder laser beam.

3. The method of claim 1, wherein the laser rangefinder is substantially horizontally offset from the designated pin.

4. The method of claim 1, further comprising mounting the laser rangefinder to the bow sight in a factory setting.

5. The method of claim 1, further comprising sighting-in the designated pin to an assigned distance.

6. The method of claim 1, wherein the preset distance comprises about a maximum distance at which a user is capable of consistently making accurate shots.

7. The method of claim 1, wherein the laser rangefinder is offset from the designated pin by less than about six inches.

8. The method of claim 1, further comprising:

aiming the designated pin at the target along the actual line of sight;

activating the rangefinder laser beam;

adjusting an elevation of the bow to an angle corresponding at least approximately to a range to the target; and firing an arrow from the bow.

9. The method of claim 8, wherein adjusting the elevation of the bow occurs substantially in a vertical plane.

10. The method of claim 1, wherein the bow site assembly further comprises a level assembly.

11. The method of claim 1, further comprising:

aiming the designated pin at the target along the actual line of sight;

activating the rangefinder laser beam;

adjusting an elevation of the bow such that the designated pin on the bow sight corresponds at least approximately to the range of the target shown on the display; and firing an arrow from the bow.

12. A targeting system for a bow, comprising:

a designate pin, the pin having an orientation adjustable by a user;

a laser rangefinder offset from the designated pin on a bow sight such that a theoretical line of sight through the designated pin intersects with a rangefinder laser beam emitted by the laser rangefinder at a preset distance;

an adjustment mechanism configured to permit a pitch and a yaw of the rangefinder laser to be adjusted by the user such that the rangefinder laser beam and an actual line of sight through the designated pin intersect at the preset distance; and a display located within a pin guard or pin bezel located adjacent to the designated pin, the display being configured to display a distance measured by the laser rangefinder;

wherein the designated pin, the laser rangefinder, the laser rangefinder adjustment mechanism, the display, the pin guard or pin bezel, and the bow sight form a unitary bow sight assembly such that a user viewing a target framed by the pin guard or pin bezel can simultaneously view the display while adjusting the orientation of the designated pin and the pitch and yaw of the laser rangefinder.

13. The targeting system of claim 12, wherein the laser rangefinder is substantially horizontally offset from the designated pin.

14. The targeting system of claim 12, wherein the designated pin permits a user to aim the laser rangefinder at the target and adjust an elevation of the bow to an angle corresponding at least approximately to the range displayed by the display.

15. The targeting system of claim 12, further comprising a level assembly adjacent to, on or within the pin guard or pin bezel.

16. The targeting system of claim 15, wherein the level assembly comprises a digital level.

17. The targeting system of claim 16, wherein the digital level is backlit.

18. The targeting system of claim 12, wherein the display is backlit.

19. The targeting system of claim 12, wherein the preset distance is about a maximum distance a user is capable of consistently making accurate shots.

20. The targeting system of claim 12, wherein the laser rangefinder is offset from the designated pin by less than about six inches.

21. The targeting system of claim 12, further comprising a processor and power supply operably connected to the laser rangefinder.

22. The targeting system of claim 21, further comprising a trigger operably connected to the processor.

23. The targeting system of claim 21, wherein the CPU and power supply are incorporated into the bow sight assembly.

24. The targeting system of claim 12, further comprising a bow mounting bracket attached thereto.

25. The targeting system of claim 12, further comprising one of a horizontal traveler and a vertical traveler.

26. The targeting system of claim 12, further comprising a sight alignment device incorporated into the bow sight.

27. The targeting system of claim 12, wherein the designated pin further comprises a fiber optic bright sight.

* * * * *